United States Patent [19]

Hipkins, Sr. et al.

[11] Patent Number: 4,679,967

[45] Date of Patent: Jul. 14, 1987

[54] TRUSS BRACKET

[75] Inventors: Edward C. Hipkins, Sr., Oakdale; Frank M. Locotos, Bridgeville, both of Pa.

[73] Assignee: F. M. Locotos Co., Inc., Pittsburgh, Pa.

[21] Appl. No.: 758,707

[22] Filed: Jul. 25, 1985

[51] Int. Cl.[4] ..... E21D 20/00

[52] U.S. Cl. ..... 405/288; 405/259

[58] Field of Search ..... 405/288, 258, 259, 260, 405/261, 228

[56] References Cited

U.S. PATENT DOCUMENTS

| | | | |
|---|---|---|---|
| 3,427,811 | 2/1969 | White | 405/259 |
| 3,509,726 | 5/1970 | White | 405/259 |
| 4,395,161 | 7/1983 | Wilson et al. | 405/288 X |
| 4,456,405 | 6/1984 | Galis | 405/288 |
| 4,498,816 | 2/1985 | Korpela et al. | 405/288 X |
| 4,596,496 | 6/1986 | Tyrell et al. | 405/288 |
| 4,601,616 | 7/1986 | Barish et al. | 405/228 |

*Primary Examiner*—Cornelius J. Husar
*Assistant Examiner*—Joseph A. Fischetti
*Attorney, Agent, or Firm*—Webb, Burden, Robinson & Webb

[57] ABSTRACT

A truss bracket for use in a mine roof support system using double tie bars. The truss bracket comprises a substantially flat, planar member for engagement with the mine roof, and an extension depending normal to the planar member. The extension has an angularly disposed channel in communication with an aperture in the planar member. The channel and aperture accommodate a rib or anchor bolt for attachment of the truss bracket. The extension also includes a pair of openings spaced from each other and from the planar member. Each of the openings accommodate a tie bar in parallel relationship to the planar member and to each other. Most preferably, the truss bracket further comprises a tie bar support ring angularly attached to the planar member to accommodate a tie bar in the event of sagging.

10 Claims, 6 Drawing Figures

TRUSS BRACKET

BACKGROUND OF THE INVENTION

1. Field of the Invention

This invention relates to a support system for a mine roof. More particularly, the invention relates to truss brackets which retain a pair of adjustable tie bars across the width of a mine roof.

2. Description of the Prior Art

In underground mining operations such as for the deep mining of coal, the unsupported rock formation above the tunnel formed in a coal seam is reinforced by roof plates retained by rib or anchor bolts against the face of the rock formation. As an alternative support system or as a supplement to the standard support system, adjustable tie bars are utilized which extend across the width of the mine roof and are supported by truss brackets.

These truss brackets are typically attached into the rock formation. The tie bar suspension systems are placed under compression to prevent the sagging of the mine roof, usually at the center of the system between brackets. The tie bars are normally rebar, standard smooth rod or cable. The hardware to retain the tie bars consists of turnbuckles, wedges and/or various header plates which are secured by anchor bolts into the rock formation above the tunnel.

One such mine roof system is illustrated in U.S. Pat. No. 3,427,811. The hardware therein consisted of a roof plate, a welded connecting link, a pair of straps, each of which was bent about a wooden block, and a turnbuckle for tightening the straps.

A need remains for a system made up of a minimum of hardware which can be easily and rapidly installed. The need further remains for a system sufficiently strong which will reduce shear loads at the various locations adjacent the hardware. The system may act to support the sagging rock formations or roof materials while maintaining a low profile to maximize roof clearance.

SUMMARY OF THE INVENTION

The truss bracket of this invention eliminates the need for several of the pieces of hardware which have been employed heretofore. The bracket is easily and rapidly installed and it eliminates shear points associated with other systems. The truss bracket enables anchor bolts to be used as the primary support before the tie bars are installed. The support system, which uses double tie bars, acts as a secondary support of loose roof materials. The invention preferably includes a tie bar support ring for added support of tie bars in the event of sagging. This support ring reduces shear load on the hardware and truss bracket.

The truss bracket comprises a substantially flat, planar member for engagement with a mine roof. The planar member has an anularly disposed aperture to accommodate a rib or anchor bolt extending angularly into the mine roof. An extension depends normally to the planar member and has an angularly disposed channel in communication with the aperture of the planar member. This channel accommodates the bolt extending through the aperture and into the mine roof. The extension also has a pair of openings spaced from each other and from the planar member. Each of these openings accommodates a tie bar in a parallel relationship to the planar member and to each other.

In the preferred embodiment, the truss bracket further comprises a tie bar support ring integrally formed and angularly disposed to the planar member. The tie bars are extended through this support ring prior to insertion through their respective openings in the extension. Most preferably, the support ring is angled at about 30° to the planar member. The channel in the extension is angled at about 45° to the planar member.

The truss bracket of this invention can be made as a unitary cast iron part or of individual components suitably connected as by welding. At the preferred angles of manufacture, the truss bracket should not exceed three inches in overall height. This will provide the bracket with a low profile to maximize roof clearance.

DESCRIPTION OF THE PREFERRED EMBODIMENTS

Figure 1:
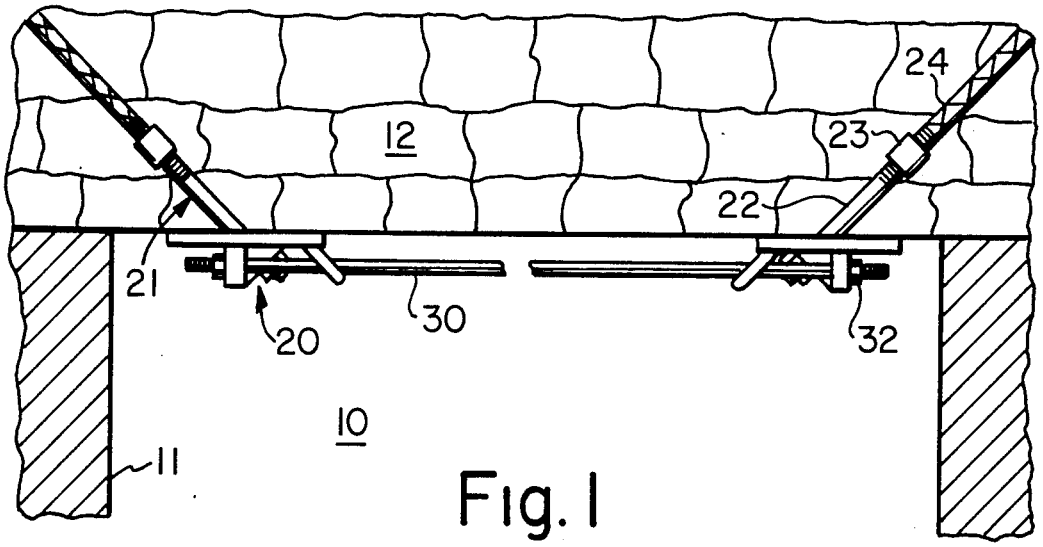
FIG. 1 is a section through a portion of a rock formation and coal seam, including the truss bracket as part of a support system for the mine roof.
Figure 2:
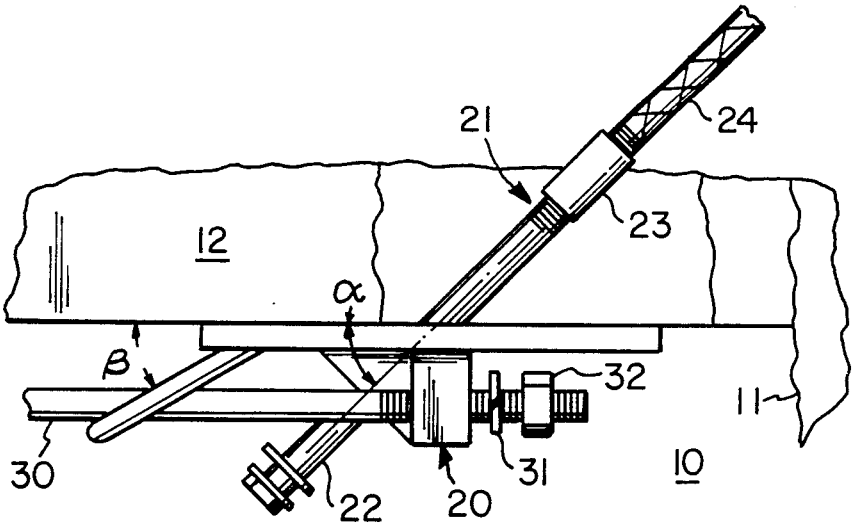
FIG. 2 is an enlarged view of the right truss bracket of FIG. 1.
Figure 3:
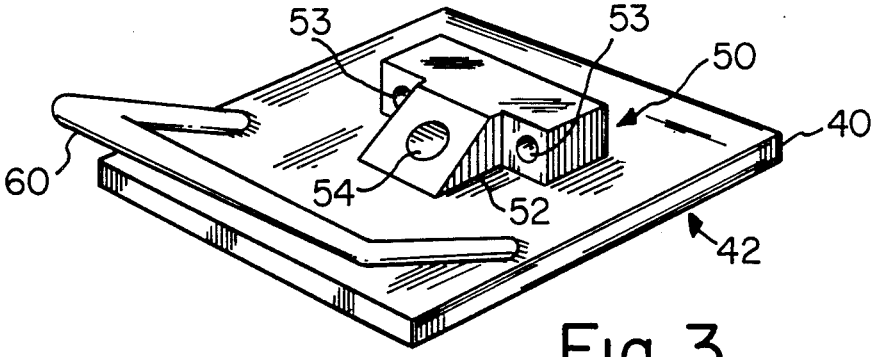
FIG. 3 is a perspective view of a truss bracket inverted from its installed position.
Figure 4:
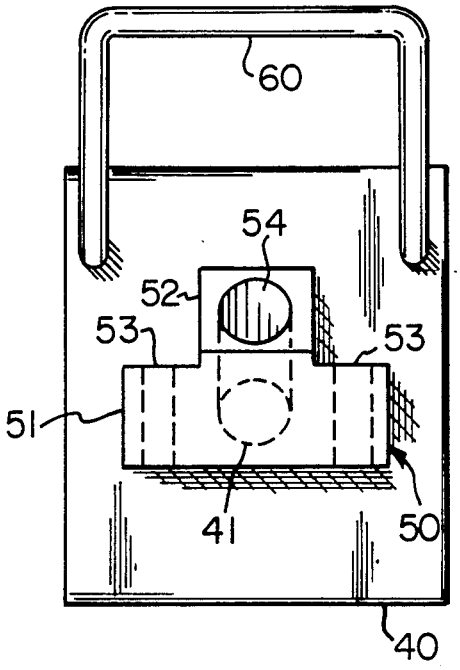
FIG. 4 is a top plan view of the bracket.
Figure 5:
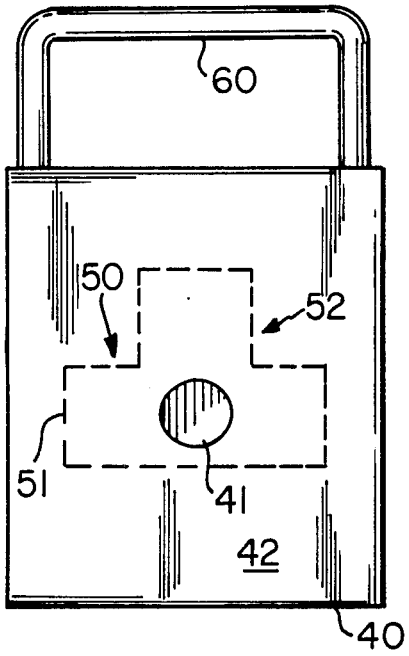
FIG. 5 is a bottom view of FIG 4.
Figure 6:
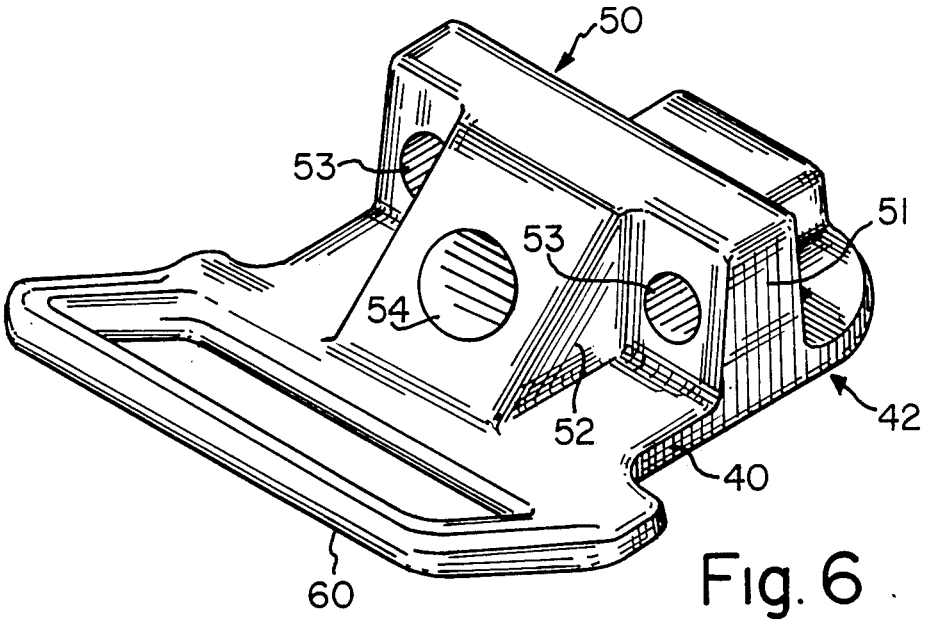
FIG. 6 is a perspective view of an inverted truss bracket as a unitary cast iron part.

The roof suspension support system of this invention generally finds primary application in deep coal mining but is equally applicable to other excavations where a roof of rock formation or the like must be supported. As shown in FIG. 1 and FIG. 2, the support system of this invention is installed in a mine tunnel 10 defined by a coal seam 11 along it sides and a rock formation 12 along its top. The bottom of the rock formation 12 forms the roof of the tunnel 10.

In the installment of a support system using this truss bracket and the double tie bars, holes are drilled into the rock formation 12 at 45° angles and along opposite sides of the tunnel 10. Truss brackets, generally 20, are attached to the rock formation 12 by placement of the anchor bolts 21 through appropriate apertures in the truss bracket 20 and into the holes in the rock formation 12. The anchor bolts 21 depicted in FIG. 1 and FIG. 2, are standard anchor bolts comprised of a mechanical bolt 22, a coupling 23 threadably connected thereto and a grouted resin bolt 24, connected at the opposite end of the coupling 23. Tension rebars and other forms of anchors may also be used depending upon the size of hole, density of rock to be supported, height of tunnel and dead weight of the roof.

A pair of cross members, in the form of tie bars 30, extend through their respective apertures in the truss bracket 20 and are retained thereagainst by means of a lock washer 31 and nut 32. The tie bar employed by this support system may be rebar, standard rod, cable or the like. The nuts 32 are tightened down at opposite ends of each tie bar 30, thus placing the system in tension and putting a compressive force against the roof between the tie bars 30. This will deter the sagging of the roof formation 12. A plurality of these support systems are utilized in spaced relationship along the roof of the mine tunnel 10.

The details of the truss bracket can best be seen in FIG. 3 through FIG. 6. The truss bracket 20 comprises a substantially flat, planar member 40 having an angularly disposed aperture 41 extending therethrough. The aperture 41 is situated to accommodate a rib or anchor bolt. The planar member 40 has a flat surface 42 for engagement with the mine roof. The truss bracket 20 maintains contact with the rock formation at the flat surface 42.

An extension, generally 50, depends normally from the planar member 40. The extension 50 includes a substantially rectangular portion 51 from which a wedge-shaped leg 52 protrudes. A pair of openings 53, each of which accommodate a tie bar, extend through opposed ends of the rectangular portion 51 of the extension 50. The openings 53 are spaced from each other and from the planar member 40 and extend in parallel relationship to the planar member 40.

Preferably, the wedge-shaped leg 52 protrudes from the rectangular portion 51 intermediate the openings 53. An angularly disposed channel 54 extends through the wedge-shaped leg 52. The channel 54 is in communication with and terminates at the aperture 41 in the planar member 40. Together, the channel 54 and aperture 41 accommodate a rib or anchor bolt to be extended into the mine roof for installation of the truss bracket 20.

Most preferably, a tie bar support ring 60 is angularly disposed to the planar member 40 of the truss bracket 20 opposite the flat surface 42. The support ring 60, which resembles a three-sided handle, serves to support the tie bars from beneath in the event the tie bars begin to sag from the weight of the rock formation. Insodoing, the tie bar support rings 60 reduce the stress load on the tie bars and anchor bolt by distributing it over the truss bracket 20 rather than localizing it at the openings 53, apertures 41 and channels 54 through which the tie bars and anchor bolts extend.

The truss bracket 20 of the invention can be manufactured from individual plates, rods and brackets welded together. Alternatively and preferably, the truss bracket 20 can be made as a unitary part from cast iron or any other suitable material, as in FIG. 6. In this embodiment, the support ring 60 is integrally formed as part of the planar member 40 and extends from its edges.

In the preferred embodiment of the invention, the truss bracket 20 includes a channel 54 extending through the extension 50 and disposed to the planar member 40 at angle $\alpha$, FIG. 2, of about 45°. The tie bar support ring 60 is attached near an end of the planar member 40 at angle $\beta$ of about 30°. Under these specifications, the truss bracket 20 maintains a low profile with a height preferably less than three (3) inches. Such a support system maximized roof clearance.

A test was conducted on the support system using the truss bracket and double tie bars. Specifically, the system tested comprising a 1-inch diameter, grade 60 threaded rebar (the anchor bolt), an 8-inch by 8-inch by ⅜-inch flat bearing plate with angle block and tie bar supports (the truss bracket) and two 1-inch diameter, grade 75 threaded rods (tie bars). A pair of truss brackets were anchored to a test platform by installation of the anchor bolts at a 45° angle therethrough. The two tie bars were connected through each truss bracket, secured by locking nuts, then connected to a 1-inch diameter threaded rod on which a 30-ton hydraulic ram was mounted. The support system was then loaded, using the ram, until failure. The maximum load achieved during the test was 54,000 pounds. Failure occurred in the threads in the nut which secured the anchor bolt and truss bracket to test platform.

The support system and truss bracket described above eliminates a number of pieces of hardware previously used. It is easily and rapidly installable. Tensile forces are applied in an axial direction in the support system employing this bracket, thereby eliminating stress points associated with force loads having multiple vector components. Lastly, with double tie bars, this invention acts as added support for loose roof formation and materials.

While the above describes the presently preferred embodiment, it may be otherwise embodied within the scope of the appended claims.

I claim:

1. A truss bracket for use in a mine roof support system comprising:

a substantially flat, planar member for engagement with a mine roof, said planar member having an angularly disposed aperture to accommodate an anchor bolt extending into the mine roof;

an extension depending normal to said planar member, said extension having a channel angularly disposed to said planar member and in axial coincidence with said aperture in said planar member to accommodate the anchor bolt extending through said aperture in said planar member and into the mine roof, said extension further having a pair of openings spaced from each other and from said planar member and positioned on opposite sides of said channel, each of said openings to accommodate a tie bar in parallel relationship to said planar member and to each other; and a tie bar support ring angularly disposed to said planar memer and spaced from said extension to form an opening in line with said pair of openings in said extension, said support ring to accommodate said tie bars extending therethrough upon sagging.

2. The truss bracket of claim 1 wherein said support ring is attached to said planar member at an angle of about 30°.

3. The truss bracket of claim 1 wherein said channel in said extension is disposed to said planar member at an angle of about 45°.

4. The truss bracket of claim 2 wherein said channel in said extension is disposed between said openings in said extension.

5. The truss bracket of claim 1 being a unitary cast iron part.

6. The truss bracket of claim 1 wherein the overall height of said bracket is less than three inches.

7. In a support system for a mine roof capable of being extended across the width of the mine roof and secured by mine roof rib bolts, the improvement comprising:

a pair of truss brackets, each of said brackets having:

a substantially flat planar member for engagement with the mine roof, said planar member having an angularly disposed aperture to accommodate an anchor bolt extending into the mine roof;

an extension depending normal to said planar member, said extension having a channel angularly disposed to said planar member and in axial coincidence with said aperture in said planar member to accommodate the anchor bolt, said extension also having a pair of openings spaced from each other and from said planar member and positioned on opposite sides of said channel, each of said openings to accommodate a tie bar in parallel relationship to said planar member and to each other;

a pair of tie bars extended through and adjustably secured to said truss bracket and tightened therebetween; and a tie bar support ring angularly disposed to said planar member and spaced from said extension, said support ring to accommodate said tie bars extending therethrough upon sagging.

8. The improvement of claim 7 wherein said support ring is attached to said planar member at an angle of about 30°.

9. The improvement of claim 7, wherein said channel is disposed to said planar member at an angle of about 45°.

10. The improvement of claim 7 wherein said truss bracket is formed as a unitary cast iron part.

* * * * *

UNITED STATES PATENT AND TRADEMARK OFFICE

CERTIFICATE OF CORRECTION

PATENT NO. : 4,679,967

DATED : July 14, 1987

INVENTOR(S) : Edward C. Hipkins, Sr. and Frank M. Locotos

It is certified that error appears in the above-identified patent and that said Letters Patent is hereby corrected as shown below:

Cover page, under heading "[73] Assignee:" and following "F. M. Locotos Co., Inc., Pittsburgh, Pa." add the additional assignee of -- H & S Machine & Supply Co., Inc., Coraopolis, Pa. --

Claim 1 - Column 4, Line 35, "memer" should read --member--.

Claim 1 - Column 4, Line 38, "bars" should read --bar--.

Claim 4 - Column 4, Line 45, "claim 2" should read --claim 3--.

Signed and Sealed this

Twenty-third Day of February, 1988

*Attest:*

DONALD J. QUIGG

*Attesting Officer*

*Commissioner of Patents and Trademarks*